US005454310A

United States Patent [19]

Hayes

[11] Patent Number: 5,454,310

[45] Date of Patent: Oct. 3, 1995

[54] SEGMENTED OSCILLATING FLUID EVAPORATOR ROLLER FOR PRINTING PRESSES

[75] Inventor: Thomas Hayes, Clark, N.J.

[73] Assignee: Varn Company, Oakland, N.J.

[21] Appl. No.: 340,665

[22] Filed: Nov. 16, 1994

[51] Int. Cl.[6] ..... B41F 31/00

[52] U.S. Cl. ..... 101/148

[58] Field of Search ..... 101/147, 148, 101/141, 142, 349, 350, 351, 352

[56] References Cited

U.S. PATENT DOCUMENTS

| | | | |
|---|---|---|---|
| 4,452,139 | 6/1984 | Dahlgren et al. | 101/148 |
| 4,524,689 | 6/1985 | Lemaster | 101/141 |
| 5,046,417 | 9/1991 | Paulson | 101/148 |
| 5,085,142 | 2/1992 | Smith | 101/148 |
| 5,209,160 | 5/1993 | Smith | 101/349 |
| 5,265,527 | 11/1993 | Tedford | 101/148 |
| 5,388,512 | 2/1995 | Tomita | 101/148 |

FOREIGN PATENT DOCUMENTS

| | | | |
|---|---|---|---|
| 290053 | 12/1986 | Japan | 101/147 |

*Primary Examiner*—Ren Yan
*Attorney, Agent, or Firm*—James W. Jakobsen

[57] ABSTRACT

A segmented oscillating fluid evaporator roller for removing excess moisture from the ink in the ink train or dampener system rollers of a printing press. The segmented oscillating roller consists of a hollow shaft having air slots along its length and into which pressurized air is admitted. Rotating and oscillating around the hollow shaft on bearings is a roller shell having roller segments attached thereon. Said roller segments run against and are frictionally driven by an inked roller in the press. Between the roller segments and through the roller shell are air orifices through which the pressurized air is expelled. The pressurized air may be heated to promote moisture evaporation. To ensure the air flows from the air slots of the hollow shaft to the air orifices of the roller shell there is an air channel tube. The air being expelled from the segmented oscillator roller can be directed to impinge on the surface of the driving roller by rotating the hollow shaft and air channel tube. Air orifices between the roller segments may also be partially or totally closed off by air control rings. A moisture evacuation assembly may be located near the nip of the segmented oscillating roller and the driving inked roller. This apparatus will remove evaporated moisture buildup from the area.

18 Claims, 4 Drawing Sheets

SEGMENTED OSCILLATING FLUID EVAPORATOR ROLLER FOR PRINTING PRESSES

BACKGROUND OF THE INVENTION

1. Field of the Invention

The present invention relates generally to lithographic printing presses and more particularly it concerns an apparatus for eliminating excess dampening solution trapped in ink found on rollers of a lithographic printing press.

2. Description of the Prior Art

During offset printing it is not uncommon to develop a build-up of excess dampening solution in the ink on the rollers. Its occurrence is inherent to the printing process. A variety of printing problems are the result. How the build-up occurs and what efforts have been made to eliminate/reduce it are described below.

Each printing head of an off-set lithographic printing press consists of several basic components and assemblies: an ink train, a dampening system, a printing plate and plate cylinder, a blanket and blanket cylinder, and an impression cylinder. These components and assemblies cooperate to lay the proper ink image and ink film thickness on the sheet or web.

The ink train transfers ink to the plate. Ink trains are ordinarily made up of an ink fountain for storing a supply of ink; a slowly rotating ink-fountain roller for metering ink from the ink fountain to the remainder of the ink train; a series of soft and hard rollers running at press speed for milling and smoothing the ink; and an ink-ductor roller for transferring ink from the ink-fountain roller to the first roller in the series of soft and hard rollers. Inking form rollers transfer the ink from the series of rollers to the plate.

The typical dampening system consists of a dampening-solution fountain, a dampener-fountain roller, and a series of rollers that transfer a controlled amount of dampening solution to a dampening form roller. The dampening form roller transfers the solution from the series of rollers to the plate.

The plate cylinder carries the printing plate. On the printing plate are ink receptive image areas and dampening solution receptive non-image areas. The lithographic printing plate is planographic. This means the image areas and non-image areas are essentially on the same plane.

In order to properly ink the image areas of the plate the dampening system usually first wets the plate's non-image areas so that the ink being transferred from the inking form rollers to the plate will adhere to the image areas only. It is a feature of printing inks to take up a certain amount of dampening solution to facilitate this process. For this reason some dampener systems are also linked to the ink train via a bridging roller. These systems are said to be partially integrated. Some dampener systems do not have a dampener form roller at all but feed dampening solution directly to the first ink form roller. These fully-integrated dampeners depend wholly on the dampening solution carrying ability of the ink for plate dampening.

The inked image on the plate is transferred to a rubber blanket attached to the outer diameter of the blanket cylinder. The image is then transferred to a paper sheet or web that passes between the blanket and impression cylinders. A characteristic of rollers carrying fluid is the 'splitting' of the fluid as it passes between contacting rollers. Fluid splitting means that as two rollers are pressed together and rotated, a percentage of fluid found on the first roller, the fluid-transferring roller, will be passed to the second roller, the fluid-receiving roller. The remaining percentage of fluid is retained on the transferring roller. The larger the percentage of fluid transfer, the greater the ability of the roller system to transfer fluid. Under the proper conditions, all rotating fluid-carrying rollers in contact function this way. The direction of fluid flow generally determines which roller is the transferring roller and which roller is the receiving roller. The degree to which a fluid splits, or rate of flow, depends on several factors; including fluid source feed rate, transferring roller to receiving roller orientation, roller train orientation, roller covering material, roller diameters and durometers, and fluid characteristics. Printing presses are designed to cause ink and dampening solution to flow toward the plate cylinder.

To a certain extent, fluid splitting works in both directions—from transferring roller to receiving roller and vice versa. In a printing press, for example, we can see that while the dampener form roller is feeding dampening solution to the non-image areas of the printing plate a small amount of ink is picked up by the dampener form roller from the image areas of the plate. Likewise, as the ink form rollers are feeding ink to the image areas on the priming plate, a small amount of dampening solution is picked up by the ink form rollers from the non-image areas of the plate. Because printing presses are designed to cause the ink and dampening solution to flow toward the plate cylinder, the effect of reverse splitting is kept to a minimum; though not eliminated.

As noted above, inks are designed to take up a certain percentage of dampening solution. This facilitates ink laydown by further wetting the non-image areas of the plate. However, too much dampening solution can be forced into the ink in the inking system either by the inking form rollers picking up fluid from the plate by reverse splitting or, if the press has a partially of fully integrated dampening system, directly through the bridging roller. In addition, because of excessive dampening solution feed, ink accumulated on the dampener form roller can be forced to take on too much dampening solution.

When an excessive amount of dampening solution is picked up by ink it becomes water logged and breaks down. This is commonly called over-emulsification. The results are extreme ghosting and loss of color density in the print, mottled print, ink piling on the inked rollers, and sheet curl resulting in misregistration and feed problems. To eliminate the problems, the press operator will usually have to clean the entire ink train and dampener and then replenish the ink and dampening solution fountains. This work stoppage results in product delivery delays and measurable economic loss.

Attempts have been made to prevent excess dampening solution buildup and/or remove the excessive dampening solution from over emulsified ink. One method is to install an air bar that directs a stream of air against the surface of one or several of the inked rollers to force evaporation of excess solution. Two inventions that exemplify this method are disclosed in U.S. Pat. No. 4,524,689 entitled "DEHYDRATION APPARATUS FOR PRINTING PRESS INKING SYSTEM" and U.S. Pat. No. 5,085,142 entitled "DAMPENING FLUID EVAPORATOR." The method is limited in that it tends to evaporate only the accumulation of excessive dampening solution occurring on the surface of the ink coated rollers. Lacking in the art is an effective fluid evaporating system that could direct a stream of air against the exterior surface of an inked roller while simultaneously working the ink so to more efficiently remove excess dampening solution - not only on the surface of the ink film but also that which is mixed into the ink film.

SUMMARY OF THE INVENTION

To more effectively eliminate excess dampening solution from the ink in the inking system and/or the dampening system form roller I have invented and disclosed herein a segmented oscillating evaporator roller.

The segmented oscillating roller may be mounted in contacting relationship with any exposed inked roller in the inking system or dampening system of an off-set lithographic printing press. The best location in the ink train has been found to be on the number one ink form or dampener form roller. Although, if either ideal roller location cannot be accessed, alternate locations such as the those rollers that are in close proximity with the first ink form and dampener form rollers will give favorable results.

Air is fed to a non-rotating hollow shaft. The air is preferably heated to further promote evaporation of dampening solution. The air travels through the hollow shaft and then passes out a plurality of air slots in the hollow shaft. The air is then guided through air guide holes in an air channel tube to orifices in a roller shell which direct the air to impinge the surface of the contacting roller. The roller shell air orifices are located between roller segments that are attached to the outer surface of the roller shell. The roller shell and roller segments are frictionally driven to rotate by the contacting roller. The present invention has built into it a mechanism for causing axial oscillation of the roller shell and roller segments in relation to the hollow shaft. Oscillating the roller causes the segments to work the ink film so that dampening solution trapped beneath the surface of the film is exposed and evaporated by the impinging air. The stream of air emanating from the roller shell orifices can be directed at various angles in relation to the contacting roller. Sections of air can be partially or completely closed off by an air control ring; thereby allowing the operator to control moisture across the width of the roller train.

The invention can also be used to promote evaporation of roller cleaning solvent after roller cleanup.

It is an object of the present invention to provide a device for promoting the evaporation of excess dampening solution from inked rollers so to prevent the printing problems associated with such excess solution.

Another object of the present invention is to provide a device that will work the ink film on the surface of an inked roller so to expose dampening solution trapped beneath the surface of said ink film and direct a stream of air at the roller surface to evaporate the exposed dampening solution.

A further object of the invention is to cause the air directed across the surface of the roller to be heated; thereby increasing the evaporation rate of the dampening solution that is worked to the surface of the ink.

Another object of the invention is to provide a roller whose jets of air being emitted along the length of the invention may be reduced or closed off; thereby allowing the operator to direct air and evaporate moisture only from those sections along the width of the contacting roller having excessive amounts of dampening solution in the ink.

Yet another object of the present invention is to provide a dampening solution evaporation apparatus that is easily retrofitable to a printing press.

Still another object is to provide an apparatus to readily remove the moisture-saturated air, generated by the segmented oscillator roller, away from the press.

Another object is to provide an aid in evaporating cleaning solvents from the rollers after press cleanup.

These and other objects and advantages of the present invention will become apparent from the accompanying figures and the following written description.

DETAILED DESCRIPTION OF THE INVENTION

Figure 1:
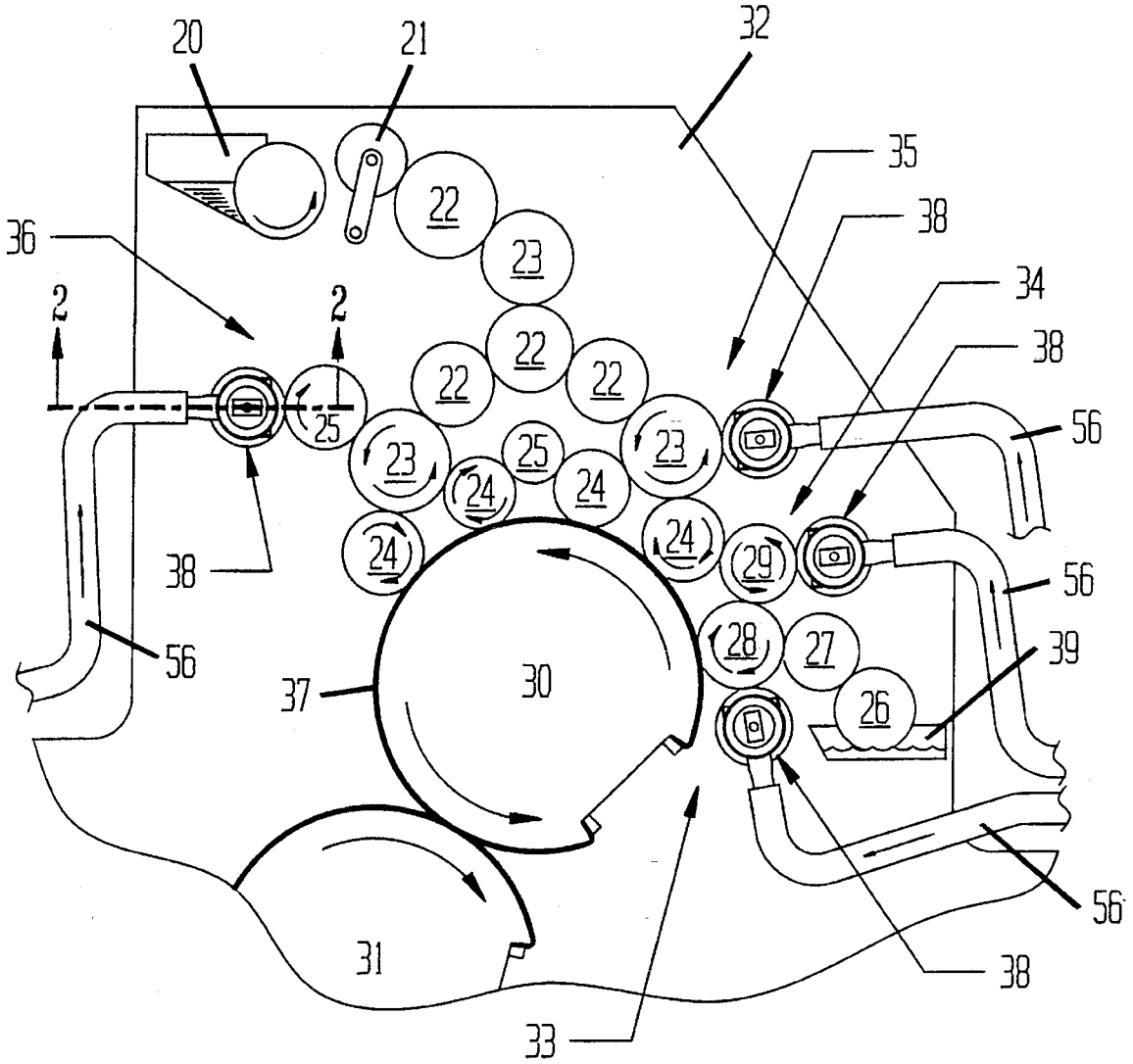
FIG. 1 is a partial cross-sectional view of the printing head of an off-set lithographic press showing four alternate locations in which the present invention may be used.

The invention will now be illustrated further with respect to the drawings. FIG. 1 illustrates a partial cross-sectional view of the printing head of a printing press. The segmented oscillating roller 38 is shown in several locations on the press. This is to exemplify possible locations on the press. Although one type of printing system is shown, it should be noted that the present invention could function on a press having a variety of roller configurations and still provide improved printing quality by eliminating the accumulation of excess dampening solution on inked rollers.

The ink train is mounted on a variety of bracket styles between nearside sideframes (not shown) and farside sideframes 32. The ink train is made up of an ink fountain and ink fountain roller 20 where a supply of ink is retained until being pulled off the ink fountain roller by the ink ductor roller 21. Ink is then transferred from the ductor roller 21 to the inking rollers that distribute and smooth ink over the length of the roller train. The rollers are shown in FIG. 1 and include ink distribution rollers 22, for smoothing the ink; axially oscillating ink vibrator rollers 23, for distributing ink over the length of the rollers; and ink rider rollers 25, also for smoothing the ink. Ink form rollers 24 transfer the ink film from the inking rollers to the printing plate 37. The printing plate is mounted on the plate cylinder 30. In contact with the plate and plate cylinder 37,30 is the rubber blanket and blanket cylinder 31.

The dampening system shown is a continuos type dampener and includes the dampening solution fountain 39 from which a dampener fountain roller 26 pulls dampening solution. The solution is metered by a metering roller 27 and then transferred to the plate 37 by the dampener form roller 28. Some presses are partially integrated and, therefore, include a bridging roller 29 that ties the dampener rollers to the ink train. And still other presses are fully integrated so they do not directly dampen the plate at all, but instead feed dampening solution into the inking system only.

Because of its comparatively compact size and simplicity in design, the segmented oscillating roller 38 can be positioned at a variety of locations on the press. All that is required is sufficient access to one of the inked rollers, mounting means near that roller to retain the segmented oscillating roller 38 in position, a path between the segmented oscillating roller 38 and the air supply (not shown) for the air feed tubing 56 to pass, and sufficient access to the segmented oscillating roller 38 so the operator can adjust, engage, and disengage the apparatus as need be. Four positions have been illustrated generally at 33, 34, 35, and 36. It is unnecessary to locate the segmented oscillating roller 38 in all four locations, however, an operator may find that employing the present invention in more than one of the four positions will markedly diminish excess dampening solution problems.

It has been determined from testing that the more proximate the invention is to the dampener system form roller 28 the better the results. This is because excess moisture will then be eliminated prior to its migrating to the rollers in the ink train. Therefore, in a non-integrating press, the best results are achieved by locating the invention in position 33, the second best results achieved by locating the invention in position 35 or directly on the first ink form roller, and the least most effective location in position 36. For partially or fully integrated presses position 34 has been found to be the second best position while positions 35 and 36 the third and forth best positions, respectfully.

Figure 2:
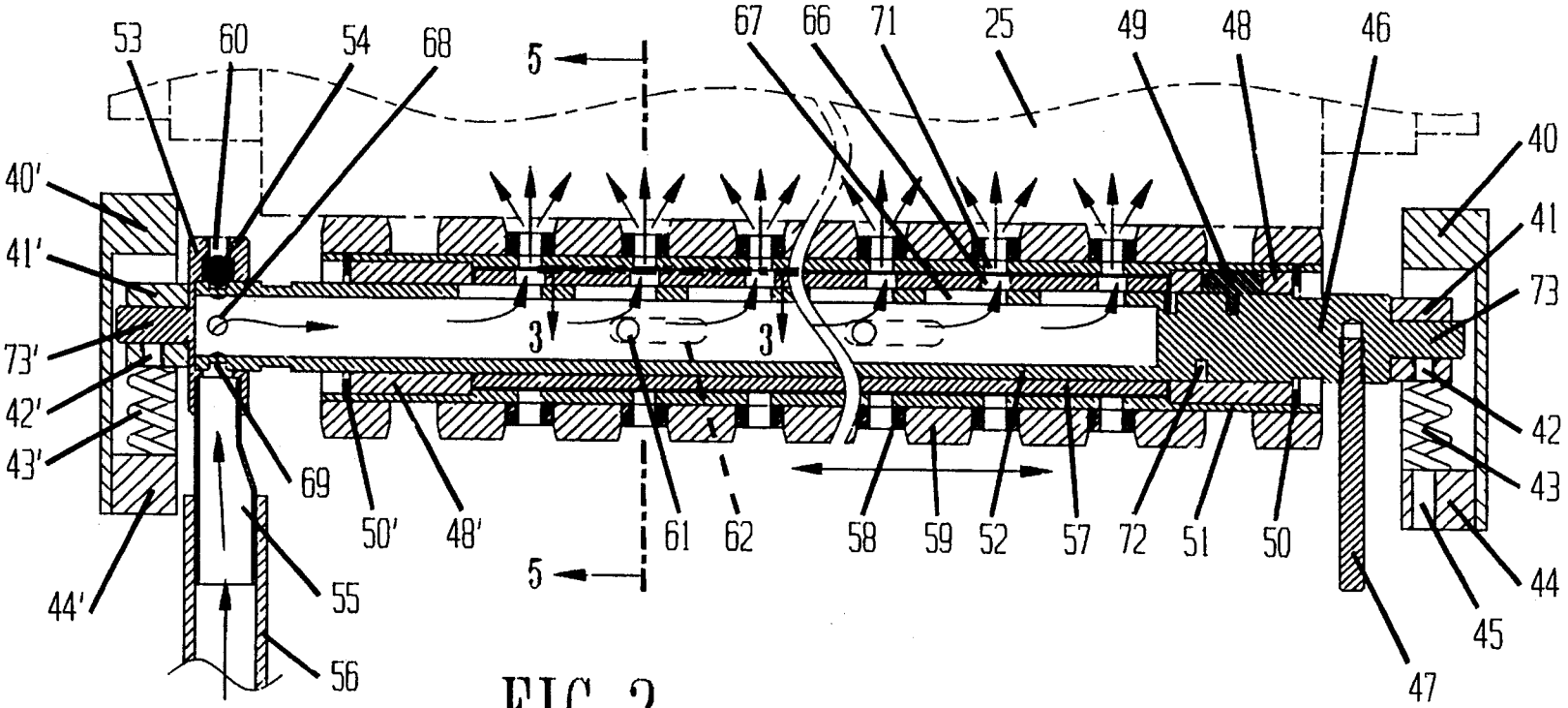
FIG. 2 is a cross-sectional view taken along line 2—2 of FIG. 1 and rotated 90° counterclockwise.

Referring now to FIG. 2 there can be seen a first embodiment of the present invention. Right hand 40 and left hand 40' roller hangers are used to mount the present invention to the press sideframes (not shown.) Slidingly mated to the hangers 40,40' are right hand 41 and left hand 41' attachment blocks. Both attachment blocks 41,41' have a rectangular cross section to prevent them from rotating in the hangers 40,40'. The right hand attachment block 41 is locked to a stepped down portion 73 of a scroll shaft journal 46 by a set screw 42. The left hand attachment block 41' is locked to a stepped down portion 73' of an air inlet housing 53 by a set screw 42'. To bias the segmented oscillating roller 38 against contacting ink rider roller 25, right hand 43 and left hand 43' compression springs are located between the attachment blocks 41,41' and right hand 44 and left hand 44' stripe adjustment blocks. A set screw access hole 45 is provided in the right hand stripe adjustment block 44 to allow loosening of the right hand attachment block set screw 42. The reason for allowing this is discussed below.

Figure 3:
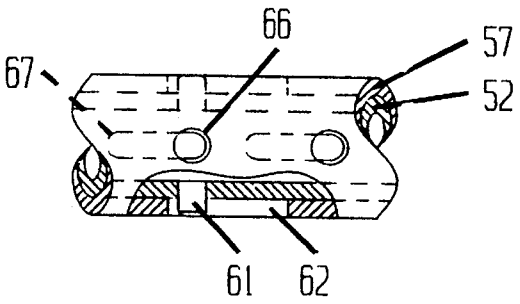
FIG. 3 is a partial view taken along line 3—3 of FIG. 2 showing only the details of the hollow shaft 52 and air channel tube 57.

Forming the axial shaft of the present invention is the scroll shaft journal 46 and a hollow shaft 52. As described above, scroll shaft journal 46 has a stepped down portion 73 that is fitted into the through-hole in the right hand attachment block 41. The opposite end of scroll shaft journal 46 closes the right end of the hollow shaft either by being spun welded to hollow shaft 52, as shown in FIG. 2, or by having a reduced diameter (detail not shown.) pressed into the hollow shaft 52. Scroll shaft journal 46 has been grooved to accept a follower 49. The groove is in the shape of a returning helix 72. This journal and follower arrangement is well known in the art for causing oscillating motion to rollers. A mechanism of this type is described in VARIABLE SPEED OSCILLATING ROLLER U.S. Pat. No. 4,869,167. Said information is incorporated herein by reference. For the embodiment shown, total oscillation motion in one direction is 0.5 inch for every one rotation of the roller. Lying in a line parallel with the axis of the hollow shaft 52 and running most of the length of hollow shaft 52 can be seen a plurality of elongated holes that act as air slots 67 (reference both FIG. 2 and FIG. 3.) Approximately perpendicular to the air slots 67 and extending radially from the axis of the hollow shaft 52 are guide pins 61. These pins 61 are pressed into holes in the hollow shaft 52 but ride freely within guide slots 62 cut into an air channel tube 57. The guide pins allow the air channel tube 57 to move laterally in relation to the hollow shaft 52 and prevent it from rotating. Near the left end of the hollow shaft 52 are a plurality of air inlet holes 68. The air inlet holes 68 are radially in line. Also in line with the air inlet holes 68 is a circumferential groove 69 which allows positioning dowel 54 to trap air inlet housing 53 onto the end of the hollow shaft 52. Air inlet housing 53 closes the left end of the hollow shaft 52. Because the inlet housing 53 is retained on the left end of hollow shaft 52 only with positioning dowel 54, hollow shaft 52 is allowed to rotate freely. Positioning dowel 54 should be made of a soft, though, abrasion resistant material such as nylon or acetal plastic. The dowel 54 is held in position by a set screw 60. An annular groove 70 is cut into the inside diameter of the air inlet housing 53 to allow air to pass around the outside diameter of the hollow shaft 52 and enter the air inlet holes 68.

Air is fed to the air inlet housing 53 through air inlet tube 55. Air is fed to the air inlet tube 55 through a flexible, though non-collapsible, air feed tube 56. Air may be supplied to the air feed tube 56 either by the presses air compressor or one dedicated for supplying pressurized air to the segmented oscillator roller 38. Since heated air holds more moisture than ambient air, it is preferable that the air fed through the present invention be heated. The air may be heated externally of the segmented oscillator roller in any conventional manner or heated within the oscillator roller 38 as described hereinafter.

Figure 4:
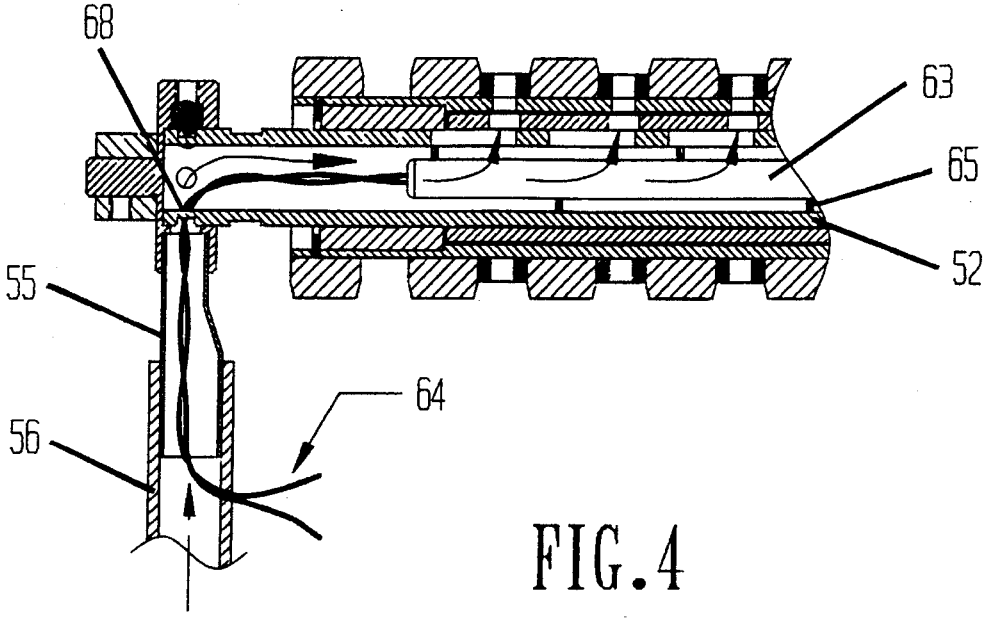
FIG. 4 is a partial cross-sectional view similar to FIG. 2; however, showing an alternate embodiment of the present invention.

FIG. 4 illustrates an alternate embodiment of the present invention in which a cartridge heater 63 is used to heat the pressurized air passing through the hollow shaft 52. A commercially available cartridge heater that was found to geometrically and thermally fit the application is the FIREROD cartridge heater manufactured by Watlow Electric Manufacturing Co. of St. Louis, Mo. The cartridge heater 63 is retained in and maintained concentric to the hollow shaft 52 by spacers 65. This arrangement ensures stable air flow and efficient heat transfer to the passing air. The heater is powered with heater leads 64 that pass from the cartridge and through the air inlet holes 68. They then travel through the air inlet tube 55 and pierce the wall of the air feed tube 56 at a convenient location. The leads 64 are attached to the proper circuitry as described by the heater cartridge manufacturer' s specifications for electrical power.

Referring now back to FIG. 2 there can be seen right hand 48 and left hand 48' bushings. Said bushings support roller shell 51 concentrically about the hollow shaft 52 and scroll shaft journal 46. Said right hand bushing 48 also retains the oscillating mechanism follower 49. Both bushings may be made from oil-impregnated sintered brass. The bushings 48,48' are retained by shoulders cut into roller shell 51 and retaining rings 50,50'.

Air channel tube 57 is also concentric to hollow shaft 52 and fills the annular void between the hollow shaft 52, left hand and right hand bushings 48, 48', and roller shell 51. Air channel tube 57, therefore, is captured between right hand 48 and left hand 48' bushings and will oscillate with the bushings 48,48' and roller shell 51. As noted above, air channel tube 57 will not rotate because of pins 61.

Figure 5:
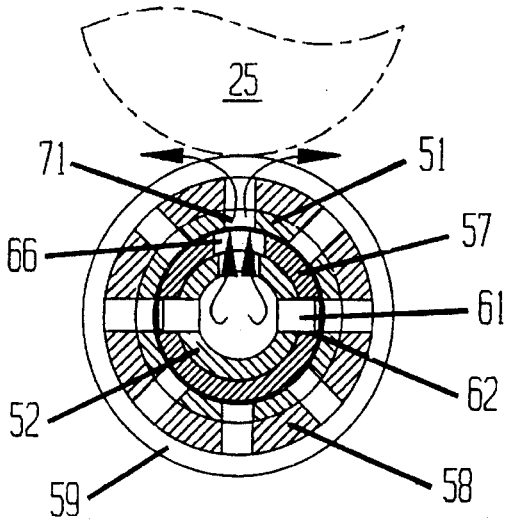
FIG. 5 is a cross-sectional view taken along line 5—5 of FIG. 2.

Referring again to both FIG. 2 and FIG. 3, it can be seen that there is an air guide hole 66 in the air channel tube 57 for each hollow shaft air slot 67. Since the hollow shaft air slots 67 accommodate the full travel of the oscillating air channel tube 57, air is always guided from the hollow shaft 52 to cooperating roller shell air orifices 71 located in roller shell 51. Also, as roller shell 51 rotates about hollow shaft 52 and air channel tube 57, air will pass through the roller shell air orifices 71 only as they pass air channel tube air guide holes 66. Now, referencing FIG. 5, it can be understood that because air orifices 71 are located circumferentially and are radially maintained in line with air guide holes 66, bursts of air exit the roller shell 51 along a line parallel with the axis of hollow shaft 52.

In order to direct the bursts of air at different angles across the surface of the contacting roller 25, the operator may, through the set screw access hole 45 (reference FIG. 2,) loosen the right hand attachment block set screw 42 and pivot the scroll shaft journal 46, the hollow shaft 52, and the air channel tube 57 by pivoting an adjustment arm 47 that is secured to the scroll shaft journal 46. Set screw 42 must be retightened after the adjustment has been made to retain the new setting.

Evenly spaced across the length of and attached to the roller shell 51 are roller segments 59 (reference FIG. 2.) These segments 59 should be made of an oleophilic material that is resistant to the corrosive effects of ink and ink solvents. Such materials as acetal plastic or ebonite have been found to satisfy these requirements. The segments 59 should have a width and be spaced apart such that their paths across contacting roller 25 overlap with each complete oscillation of the roller shell 51. This ensures proper working of the ink film on the contacting roller 25; thus causing the trapped dampening solution to become exposed and evaporated by air emanating from the segmented oscillating roller 38.

Figure 6:
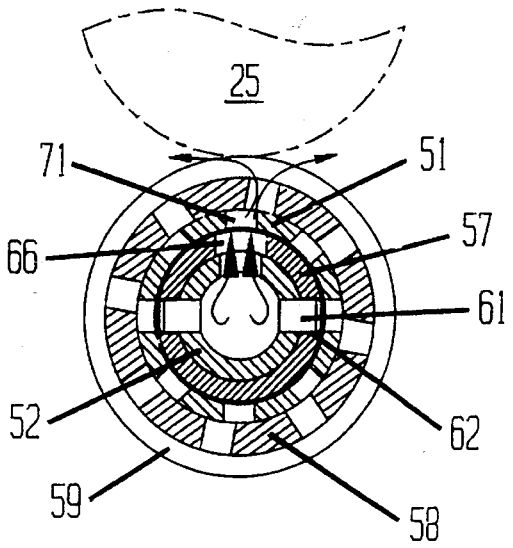
FIG. 6 is a cross-sectional view similar to FIG. 5; however, showing the restriction of air flow caused by rotating an air control ring 58.

Air control rings 58 are located between each roller segment 59 where there are roller shell air orifices 71. The amount of air exiting the roller shell air orifices 71 can be regulated segment by segment with these rings 58 (ref. FIG. 6) from fully open to fully closed and any degree therebetween. This adjustment is done by rotating the ring 58 about the roller axis. It allows the operator to control moisture removal across the width of contacting roller 25 depending on the job and conditions on press.

Figure 7:
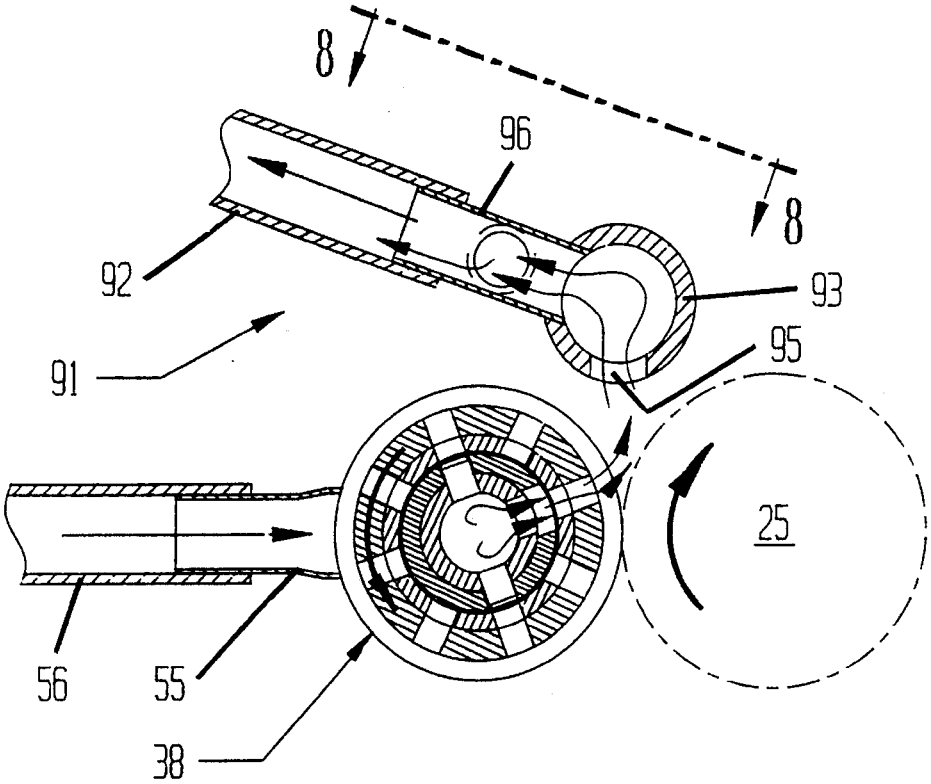
FIG. 7 is a cross-sectional view similar to FIG. 5; however, rotated 90° clockwise and showing an alternate embodiment of the present invention that includes an apparatus for removing water-saturated air from near the roller surfaces.
Figure 8:
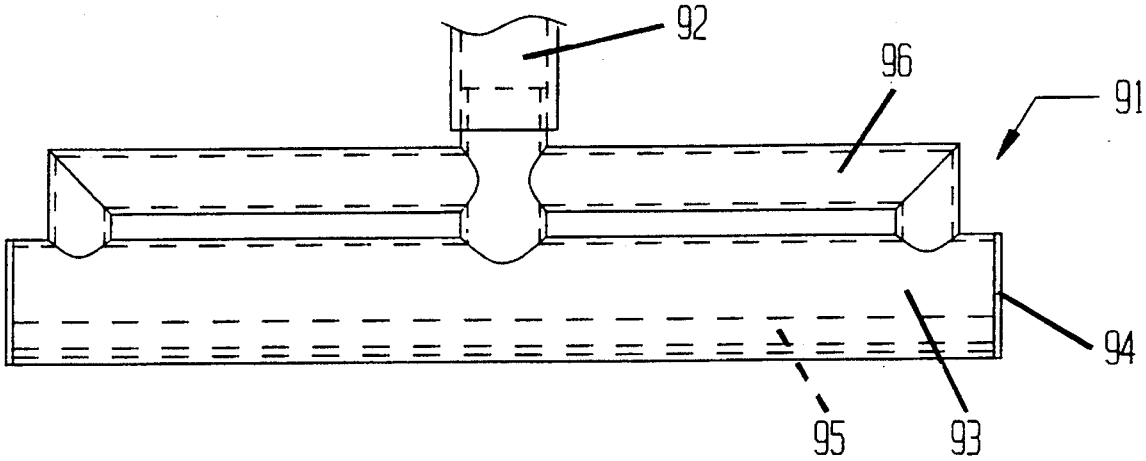
FIG. 8 is a plan view taken along line 8—8 of FIG. 7 and rotated approximately 70° clockwise showing the moisture evacuation assembly 91.

Another embodiment of the present invention can be seen in FIG. 7 and FIG. 8. It includes the invention as described above in conjunction with a moisture evacuation assembly shown generally at 91. Evacuation assembly 91 comprises a vacuum chamber 93 having a length approximately equal to that of the segmented oscillating roller 38. The ends of vacuum chamber 93 are closed with end caps 94. A slot 95, through which moisturized air is drawn, runs the length of the vacuum chamber 93. A manifold 96 is attached to the vacuum chamber 93 providing even extraction of air across the length of the chamber 93. Moisturized air passes through a flexible tube 92. The flexible tube, 92 is then tied into any conventional vacuum pump arrangement (not shown.) Said evacuation assembly 91 may be rigidly secured to the sideframes of the press in any standard manner. The assembly is most effective when located on the outward nip side of the segmented oscillating roller and contacting roller interface 38,25. The slot 95 should be located just above the interface. In this position moisture vaporized by the segmented oscillating roller 38 will be readily removed from the vicinity. This combination optimizes the segmented oscillating roller 38 in that it causes rapid extraction of moisture laden air. Best results have been acquired by extracting approximately 30% more air by volume than what is delivered through the segmented oscillator 38. This process removes the vapor before the surrounding air becomes saturated and condenses on press parts.

I claim:

1. A segmented oscillating fluid evaporator roller assembly for evaporating excess dampening solution from the ink in a printing press having a first and second sideframe, an ink train, and a dampening system, the segmented oscillating evaporator roller assembly comprising a segmented oscillating roller having a hollow shaft having a first and second end and having a plurality of air slots through the wall of the hollow shaft and lying in a line parallel with the axis of the hollow shaft;

means for closing the first end of the hollow shaft;

means for closing the second end of the hollow shaft;

means for receiving pressurized air to the first end of the hollow shaft;

means for supplying pressurized air to the means for receiving pressurized air to the first end of the hollow shaft;

means for mounting the segmented oscillating roller to the first and second press sideframes in close proximity to a contacting roller in the printing press;

means for rotationally mounting the first end of the hollow shaft to the means for mounting the segmented oscillating roller to the press sideframes;

means for lockingly mounting the second end of the hollow shaft to the means for mounting the segmented oscillating roller to the press sideframes;

means for pivotally adjusting the hollow shaft about the axis of said hollow shaft;

a roller shell having a first and second end, said roller shell concentrically located about, but shorter than, the hollow shaft, said roller shell having a plurality of air orifices in line with the plurality of air slots of the hollow shaft and extending radially about the roller shell's circumference;

bearing means located at the first and second end of the roller shell between the roller shell and hollow shaft for allowing the roller shell to rotate and oscillate about the hollow shaft;

a plurality of roller segments attached to the outer surface of the roller shell, said roller segments being located outside the first and last radially extending air orifices in said roller shell and between each set of radially extending air orifices in said roller shell;

means for oscillating the roller shell in a direction parallel to the axis of and in relation to the hollow shaft;

means for guiding air between the plurality of air slots in the hollow shaft and the plurality of air orifices in the roller shell that lie in line with the plurality of air slots in the hollow shaft; and means for biasing the segmented oscillating roller against the contacting roller in the printing press.

2. The segmented oscillating fluid evaporator roller assembly as in claim 1 wherein the means for closing the first end of the hollow shaft, the means for rotationally mounting the first end of the hollow shaft to the means for mounting the segmented oscillating roller to the press sideframes, and the means for receiving pressurized air to the first end of the hollow shaft comprises an air inlet housing rotatingly mounted to the first end of the hollow shaft and non-rotatingly engaged with the means for mounting the segmented oscillating roller to the press sideframes;

an air inlet tube sealingly secured to the air inlet housing;

a flexible air feed tubing having its first end sealingly secured to the air inlet tube and its second end sealingly secured to the means for supplying pressurized air; and wherein the first end of the hollow shaft has a plurality of air inlet holes that cooperate with the air inlet tube.

3. The segmented oscillating fluid evaporator roller assembly as in claim 1 wherein the bearing means comprise oil impregnated sintered brass bushings.

4. The segmented oscillating fluid evaporator roller assembly as in claim 1 wherein the means for closing the second end of the hollow shaft and the means for oscillating the roller shell in a direction parallel to the axis of and in relation to the hollow shaft comprises a scroll shaft journal having a returning helix on its outer diameter, said scroll shaft journal having one end secured to the second end of the hollow shaft and the opposite end of the scroll shaft journal attached to the means for lockingly mounting the second end of the hollow shaft to the means for mounting the segmented oscillating roller to the press sideframes;

a follower captured by the bearing means and engaging the returning helix in the scroll shaft journal.

5. The segmented oscillating fluid evaporator roller assembly as in claim 4 wherein the means for pivotally adjusting of the hollow shaft about the axis of said hollow shaft comprises a scroll shaft adjustment arm secured to the scroll shaft journal.

6. The segmented oscillating fluid evaporator roller assembly as in claim 1 wherein the means for guiding air between the plurality of air slots in the hollow shaft and the plurality of air orifices in the roller shell that lie in line with the plurality of air slots in the hollow shaft comprises an air channel tube slidingly mounted between and concentric to the hollow shaft and roller shell, said air channel tube also being positioned between the bearing means, said air channel tube having at least one tube guide slot through the wall of the air channel tube, said air channel tube having a plurality of air guide holes through the wall of the air channel tube lying in line with the plurality of hollow shaft air slots; and at least one guide pin integral to the hollow shaft and engaging said at least one tube guide slot whereby the air channel tube moves with the axial oscillation of the roller shell but does not rotate with the roller shell and, thereby, always guides air from the plurality of hollow shaft air slots to the plurality of roller shell air orifices that lie in line with the plurality of air slots in the hollow shaft.

7. The segmented oscillating fluid evaporator roller assembly as in claim 6 wherein the air channel tube is made of nylon material.

8. The segmented oscillating fluid evaporator roller assembly as in claim 1 wherein the means for lockingly mounting the second end of the hollow shaft to the means for mounting the segmented oscillating roller to the press sideframes comprises a right hand stepped down portion extending from the means for closing the second end of the hollow shaft;

a right hand attachment block rotatingly mounted on the right hand stepped down portion and non-rotatingly engaged with the means for mounting the segmented oscillating roller to the press sideframes; and a set screw threaded into the right hand attachment block and tightenable against the stepped down portion to prevent rotation of the hollow shaft.

9. The segmented oscillating fluid evaporator roller assembly as in claim 1 wherein the roller segments are made of acetal plastic.

10. The segmented oscillating fluid evaporator roller assembly as in claim 1 further comprising air control rings rotatingly mounted on the outside diameter of the roller shell and in each space between the roller segments having air orifices, said control rings having holes extending radially that cooperate with the plurality of roller shell air orifices that lie between the roller segments.

11. The segmented oscillating fluid evaporator roller assembly as in claim 1 further comprising a means for heating the pressurized air.

12. The segmented oscillating fluid evaporator roller assembly as in claim 11 wherein the means for heating the pressurized air comprises a cartridge heater located within the hollow shaft;

cartridge heater leads extending from an end of and supplying electrical current to the cartridge heater; and a plurality of spacers between the cartridge heater and the hollow shaft for centering the cartridge heater within the hollow shaft.

13. The segmented oscillating fluid evaporator roller assembly as in claim 1 further comprising a means for removing the evaporated fluid from the printing press.

14. The segmented oscillating fluid evaporator roller assembly as in claim 13 wherein the means for removing the evaporated fluid from the printing press is a moisture evacuation assembly attached to and between the first and second printing press sideframes and located near the interface of the segmented oscillating roller and the contacting roller, said moisture evacuation assembly comprising a vacuum chamber extending the length of the segmented oscillating roller and having a slot the length of the vacuum chamber situated just over the segmented oscillating roller and contacting roller interface;

end caps integrally attached to each end of the vacuum chamber;

a manifold integrally attached to and communicating with the interior of the vacuum chamber;

a means for creating a vacuum; and a flexible moisture removal tube communicatingly attaching the manifold to the means for creating a vacuum.

15. A segmented oscillating fluid evaporator roller assembly for evaporating excess dampening solution from the ink in a printing press having a first and second sideframe, an ink train, and a dampening system, the segmented oscillating evaporator roller assembly comprising a segmented oscillating roller having a hollow shaft having a first and second end and having a plurality of air slots through the wall of the hollow shaft and lying in a line parallel with the axis of the hollow shaft and also having a plurality of air inlet holes at the first end of the hollow shaft;

means for mounting the segmented oscillating roller to the first and second press sideframes in close proximity to a contacting roller in the priming press;

a means for supplying pressurized air;

a roller shell having a first and second end, said roller shell concentrically located about, but shorter than, the hollow shaft, said roller shell having a plurality of air orifices in line with the plurality of air slots of the hollow shaft and extending radially about the roller shell's circumference;

bearing means located at the first and second end of the roller shell between the roller shell and hollow shaft for allowing the roller shell to rotate and oscillate about the hollow shaft;

an air inlet housing rotatingly mounted to the first end of the hollow shaft and non-rotatingly engaged with the means for mounting the segmented oscillating roller to the press sideframes;

an air inlet tube sealingly secured to the air inlet housing and in alignment with the hollow shaft air inlet holes;

a flexible air feed tubing having its first end sealingly secured to the air inlet tube and its second end sealingly secured to the means for supplying pressurized air;

a scroll shaft journal having a returning helix on its outer diameter, said scroll shaft journal being secured at one end to the second end of the hollow shaft;

a stepped down portion extending from the opposite end of the scroll shaft journal;

a follower captured by the bearing means and engaging the returning helix in the scroll shaft journal;

a right hand attachment block rotatingly mounted on the right hand stepped down portion and non-rotatingly engaged with the means for mounting the segmented oscillating roller to the press sideframes;

a set screw threaded into the right hand attachment block and tightenable against the stepped down portion to prevent rotation of the hollow shaft;

means for pivotally adjusting the hollow shaft about the axis of said hollow shaft;

a plurality of roller segments attached to the outer surface of the roller shell, said roller segments being located outside the first and last radially extending air orifices in said roller shell and between each set of radially extending air orifices in said roller shell;

an air channel tube slidingly mounted between and concentric to the hollow shaft and roller shell, said air channel tube also being positioned between the bearing means, said air channel tube having at least one tube guide slot through the wall of the air channel tube, said air channel tube having a plurality of air guide holes through the wall of the air channel tube lying in line with the plurality of hollow shaft air slots;

at least one guide pin integral to the hollow shaft and engaging at least one tube guide slot whereby the air channel tube moves with the axial oscillation of the roller shell but does not rotate with the roller shell and, thereby, always guides air from the plurality of hollow shaft air slots to the plurality of roller shell air orifices that lie in line with the plurality of air slots in the hollow shaft; and means for biasing the segmented oscillating roller against the contacting roller in the printing press.

16. The segmented oscillating fluid evaporator roller assembly as in claim 15 further comprising air control rings rotatingly mounted on the outside diameter of the roller shell and in each space between the roller segments having air orifices, said control rings having holes extending radially that cooperate with the plurality of roller shell air orifices that lie between the roller segments.

17. The segmented oscillating fluid evaporator roller assembly as in claim 15 further comprising a means for heating the pressurized air.

18. The segmented oscillating fluid evaporator roller assembly as in claim 15 further comprising a means for removing the evaporated fluid from the printing press.

* * * * *